United States Patent [19]

Sasaki et al.

[11] Patent Number: 4,713,291

[45] Date of Patent: Dec. 15, 1987

[54] FRAGRANT FIBER

[75] Inventors: Makoto Sasaki; Jun Yoshida; Yoshishige Shimizu; Kiyoshi Akazawa; Eiji Kishita; Kaoru Hirata, all of Toyohashi, Japan

[73] Assignee: Mitsubishi Rayon Company Ltd., Tokyo, Japan

[21] Appl. No.: 773,038

[22] Filed: Sep. 6, 1985

[30] Foreign Application Priority Data

Sep. 6, 1984 [JP] Japan ..... 59-186842
Feb. 27, 1985 [JP] Japan ..... 60-38415
Feb. 27, 1985 [JP] Japan ..... 60-38416

[51] Int. Cl.[4] ..... D02B 3/00

[52] U.S. Cl. ..... 428/373; 428/36; 428/374; 428/375; 428/376; 428/394; 428/395; 428/396; 428/397; 428/398; 428/483; 428/905; 264/171

[58] Field of Search ..... 428/375, 376, 36, 483, 428/396, 397, 395, 398, 372, 373, 374, 905; 264/171

[56] References Cited

U.S. PATENT DOCUMENTS 3,688,985 9/1972 Engel ..... 428/905
3,755,064 8/1973 Maierson ..... 428/372
4,515,909 5/1985 Sawano et al. ..... 428/905

FOREIGN PATENT DOCUMENTS 48-93714 12/1973 Japan .
011232 2/1982 Japan ..... 428/398
1315471 5/1973 United Kingdom ..... 428/395

*Primary Examiner*—George F. Lesmes
*Assistant Examiner*—S. A. Gibson
*Attorney, Agent, or Firm*—Oblon, Fisher, Spivak, McClelland, & Maier

[57] ABSTRACT

A fragrant sheath-core composite fiber suitable for bedding and having a cross-section including a sheath and a core including a hollow portion, wherein an aromatic perfume having a boiling point higher than 150° C. under normal pressure is incorporated and dipersed in an amount 0.1 to 10.0% by weight in a thermoplastic polymer constituting the core. The core component is preferably a polyethylene type polymer, and the sheath component is preferably a polyethylene terephthalate polymer. One of typical compositions of the aromatic perfume is an essential oil mixture including (1) 10 to 20% of lemon oil, (2) 5 to 15% of bergamot oil, (3) 2 to 8% of lavender oil, (4) 2 to 8% of lemongrass oil, (5) 2 to 8% of cedarwood oil and (6) 0.5 to 1.5% of jasmine absolute.

7 Claims, 14 Drawing Figures

FRAGRANT FIBER

BACKGROUND OF THE INVENTION

1. Field of the Invention

The present invention relates to a fiber suitable for use in the field of bedding and interior articles, which fiber is incorporated into wadding for sleeping mats, coverlets, pillows, and stuffed dolls, and pile yarns, loop yarns, and cut pile yarns of blankets, carpets and the like, to impart a durable fragrance to these articles. Moreover, the present invention relates to a fiber suitable for use in the field of bedding and interior articles, in which fiber natural essential oils and components isolated from natural essential oils are used as the aromatic perfume, to impart a durable "forest therapy effect" to the articles described above.

2. Description of the Related Art

As means for imparting a fragrance to fibers, a method has been adopted in which a perfume is adsorbed in or stuck to a final fibrous product by a post treatment. However, this method is defective in that the applied fragrance is readily removed by water washing or laundering, or the speed of loss of the perfume by volatilization is high and the given fragrance is not durable. This defect is especially conspicuous when a natural essential oil or a component isolated from a natural essential oil, which is collected from natural wood, is used as the perfume, because almost all of the components of natural essential oils are monoterpene and dipertene compounds which have a boiling point of 150° C. to 190° C. and are promptly volatilized in air.

To eliminate the abovesaid quick disappearance of fragrance from the final fibrous product, Japanese Unexamined Patent Publication (Kokai) No. 48-93714 discloses a proposal, in which perfume is dispersed in a core component of a sheath-core type synthetic fiber. This fiber, however, has a drawback in that the fragrant effect is very low because the perfume can be volatilized to outer air only from an end surface thereof having a narrow area and in that thickness thereof must be very large so as to result in an effective fragrance, which degrades a flexibility of the fiber.

SUMMARY OF THE INVENTION

It is a primary object of the present invention to provide a fragrant fiber in which the above defect of the conventional technique is eliminated and which has a durable fragrance having a high washing resistance.

In accordance with the present invention, there is provided a fragrant sheath-core composite fiber having a cross-section comprising a sheath and a core including a hollow portion, wherein an aromatic perfume having a boiling point higher than 150° C. under normal pressure is incorporated and dispersed in an amount of 0.1 to 10% by weight in a thermoplastic polymer constituting the core.

BRIEF DESCRIPTION OF THE DRAWINGS

Other objects and advantages of the present invention will be more apparent from the description of the preferred embodiments with reference to the accompanying drawings wherein.

DESCRIPTION OF THE PREFERRED EMBODIMENTS

The present invention will now be described in detail.

The fiber of the present invention has a durable fragrance having an excellent washing resistance for the following reasons. In the present invention, a perfume is incorporated and dispersed in the interior of a thermoplastic polymer and this polymer constitutes a core having a hollow portion in the cross-section of a sheath-core composite fiber. Accordingly, the volatile component of the perfume can diffuse into air only through the hollow portion present in the cross-section of the fiber along the longitudinal direction of the fiber, and therefore, an especially high washing resistance can be manifested. Furthermore, since the hollow portion is always filled with the volatile component of the perfume, volatilization of the perfume is controlled and the fragrance lasts longer.

Figure 1:
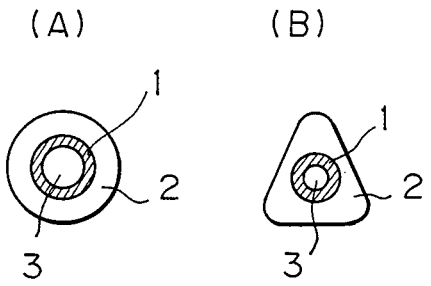
FIG. 1A,B is a cross-sectional view of an example of the hollow sheath-core composite fiber of the present invention.

Examples of the cross-section of the core-sheath composite fiber of the present invention having a hollow portion in the core in the cross-section are shown in FIG. 1. Note, sections that can be adopted in the present invention are not limited to those shown in FIG. 1.

In view of the properties of the fiber, especially the bulkiness when the fiber is used for a wadding and the smooth volatilization of the perfume incorporated in the core-constituting polymer, it is preferred that the cross-section of the fiber should have a shape of a substantially true circle as shown in FIG. 1-(A).

In the present invention, it is indispensable that the area ratio of the hollow portion in the cross-section of the fiber, that is, the hollow ratio, should be at least 5%. If this hollow ratio is lower than 5%, volatilization of the perfume is controlled to a low level and the fragrant effect is insufficient. A higher hollow ratio is more preferred, but in the case of a sheath core composite fiber, it is very difficult to increase the hollow ratio over 50%.

The kind of the polymer constituting the core of the hollow core-sheath composite fiber is not particularly critical, if the polymer is wet-, dry- or melt-spinnable. However, from the viewpoint of ease of production, a melt-spinnable thermoplastic polymer is preferred. Almost all perfumes, especially natural essential oil components, are monoterpene and diterpene compounds having a boiling point of 150° C. to 190° C., have a poor heat resistance, and are easily evaporated and decomposed by heat. Accordingly, it is especially preferred that a thermoplastic polymer having an especially low melting point (softening point) be used, a perfume be incorporated and dispersed in this thermoplastic polymer, and the composite melt spinning be carried out at a low temperature. It is also preferred that this core-constituting thermoplastic polymer be a polymer not hydrolyzed by water. This is because industrially complicated operations are necessary for drying the perfume and incorporating and dispersing the perfume in the polymer while maintaining the dry state, and these complicated operations are not preferable from an economical viewpoint.

As preferred polymers, there can be mentioned ethylene homopolymers and ethylene copolymers (generically called "polyethylene type polymers" hereinafter).

As the ethylene monopolymer, there can be used any low density polyethylene, medium density polyethylene, and high density polyethylene. Of course, so-called linear polyethylene (containing a small amount of a $C_4$ or $C_6$ comonomer component in many cases) also can be used. As the ethylene copolymer, there can be used an ethylene/vinyl acetate copolymer in which ethylene and vinyl acetate are copolymerized at a ratio of from 95/5 to 70/30, and an ethylene/ethyl acrylate copolymer in which ethylene and ethyl acrylate are copolymerized at a ratio of from 95/5 to 70/30.

Where a thermoplastic polymer is arranged in the core, it is preferred that the polymer constituting the sheath of the hollow sheath-core fiber also be a thermoplastic polymer. A suitable thermoplastic polymer is selected from among polymers customarily used for the production of synthetic fibers, such as polyolefins, polyamides, and polyesters. In view of the fiber performances, especially the bulkiness when the fiber is used for a wadding, the nerve, and the resistance to fatigue setting, use of a polyester is recommended. In this case, in order to sufficiently bring out excellent fiber performances, it is most preferable to use a polyethylene terephthalate polymer in which at least 95 mole % of recurring units are ethylene terephthalate units.

Figure 2:
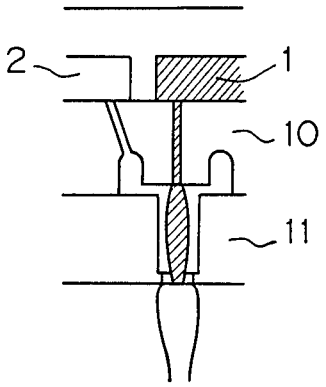
FIG. 2 is a view showing the longitudinal section of an example of the spinneret zone of a composite melt-spinning apparatus.
Figure 3:
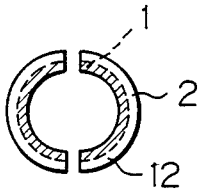
FIG. 3 is a diagram illustrating the arrangement of core-constituting and sheath-constituting polymers corresponding to the shape of a spinning extrusion hole.
Figure 4:
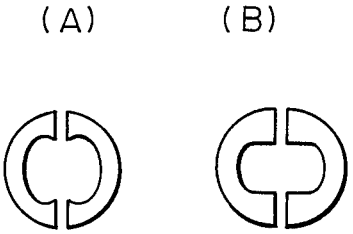
FIG. 4A,B is a diagram illustrating the configuration of a spinning extrusion hole slit for obtaining the fiber cross-section shown in FIG. 1.
Figure 5:
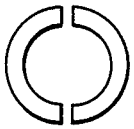
FIG. 5 is a diagram illustrating the configuration of a spinning extrusion hole slit customarily used for the production of a hollow fiber.
Figure 6:
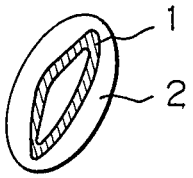
FIG. 6 is a diagram showing the cross-section of a hollow sheath-core composite fiber prepared from the spinning extrusion hole slit shown in FIG. 5.

The hollow sheath-core fiber of the present invention can be prepared, according to, for example, the following method. A description will now be made with reference to a fiber having a cross-section as shown in FIG. 1-(A), by way of example. Two kinds of polymers, that is, a polymer 1 (constituting the core) and a polymer 2 (constituting the sheath), are spun in a core-sheath arrangement from a composite spinning spinneret apparatus shown in FIG. 2, and according to customary procedures, the spun fiber is cooled by cooling air, an oiling agent is applied to the fiber, and the fiber is introduced into a can. Examples of the extrusion hole of the spinneret and the sheath-core arrangement of the two polymers are illustrated in FIG. 3. The shape of the extrusion hole of the spinneret is important, and in order to impart a shape of a true circle to the hollow portion of the cross-section of the fiber, a special configuration should be given to both ends of the arcuate slit as shown in FIGS. 4-(A) and 4-(B). When a conventional spinneret having an ordinary extrusion hole shape as shown in FIG. 5 is used, the cross-section of the fiber comes to have a shape as shown in FIG. 6, and good results cannot be obtained.

Figure 7:
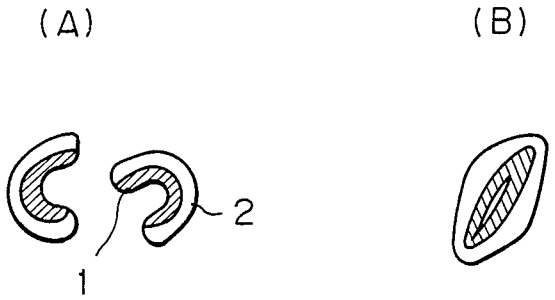
FIG. 7A,B is a diagram illustrating the cross-section of a fiber obtained when the difference of the melt viscosity between core-constituting and sheath-constituting polymers is not appropriate.

The difference of the melt viscosity at the melt extrusion between the core-constituting polymer and the sheath-constituting polymer is an important factor for obtaining the hollow sheath-core fiber of the present invention. It is sufficient if various polymers differing in the polymerization degree are combined and spun and a most preferred combination of the polymerization degrees is empirically determined. Where a polyethylene type polymer is arranged in the core and a polyethylene terephthalate polymer is arranged in the sheath, it is indispensable that the melt flow index (M.I.) of the polyethylene type polymer should be 0.5 to 25 (as determined according to ASTM D-1238; unit, g/min) and the relative viscosity of the polyethylene terephthalate polymer should be 1.55 to 1.70 (as determined in m-cresol at 25° C.). If the polymers used fail to satisfy these requirements, a hollow portion is not formed at all, or even when a hollow portion is formed, the hollow ratio is extremely low and the hollow sheath-core fiber of the present invention cannot be obtained. In short, it is important that two polymers be selected so that at the time of melt extrusion, the melt viscosity of the sheath polymer is a little higher than that of the core polymer. If the melt viscosity of the sheath polymer is considerably higher than that of the core polymer, the fiber comes to have a cross-section as shown in FIG. 7-(A), and if the melt viscosity of the sheath polymer is lower than that of the core polymer, the fiber comes to have a cross-section as shown in FIG. 7-(B).

Figure 8:
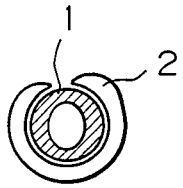
FIG. 8 is a diagram illustrating the cross-section of a fiber obtained when the volume ratio between core-constituting and sheath-constituting polymers is not appropriate.

In the present invention, it is indispensable that the volume ratio of the core-constituting polymer to the sheath-constituting polymer should be in the range of from 20/80 to 50/50. If the core polymer/sheath polymer volume ratio exceeds 50/50, it becomes difficult to prepare a definite sheath-core structure and the proportion of a fiber cross-section as shown in FIG. 8 is increased. If the core polymer/sheath polymer volume ratio is lower than 20/80, the amount of the perfume to be incorporated into the core polymer is decreased and the fragrant effect becomes insufficient. An extra-ordinary increase of the amount of the perfume to be incorporated into the core polymer results in a reduction of the melt-spinning stability and causes breakage of the single filaments by blowing.

The perfume to be incorporated into the core-constituting polymer in the hollow sheath-core fiber of the present invention will now be described.

Any artificial synthetic perfume and natural extracted perfume can be used in the present invention. Of course, a blend of several kinds of perfumes may be used. It is indispensable in the present invention that the boiling point of the perfume under normal pressure should be higher than 150° C. If the boiling point of the perfume used is lower than 150° C., the number of thermoplastic polymers that can be used for formation of the sheath of the sheath-core composite fiber of the present invention is drastically limited, and preferable polymers such as polypropylene, polyamides, and polyesters cannot be used.

In the present invention, it is indispensable that the amount of the perfume incorporated and dispersed in the thermoplastic polymer constituting the core should be 0.1 to 10.0% by weight, preferably 0.5 to 2.0% by weight.

If the amount of the perfume is smaller than 0.1% by weight, the fragrant effect is weakened, and if the amount of perfume is larger than 10.0% by weight, the spinning stability is reduced and yarn breakage often occurs.

The kind of perfume used in the present invention is not particularly critical. For example, when the fiber of the present invention is mixed in a wadding for a sleeping mat, a coverlet or a pillow, use of an essential oil collected from a needle-leafed tree as a calmative oil is recommended, because attainment of an effect resembling the forest therapy effect is expected. Furthermore, when the fiber of the present invention is mixed in a wadding for a stuffed doll, use of a perfume having a scent of a fruit such as strawberry or pineapple is recommended. Of course, a perfume having a scent of a flower or citrus fruit may be used.

It is known that perfumes have a spiritual or physiological action, and it has recently been clarified that plant essential oils have certain physiological activities and accompanying influences on mind and body. The new therapy of remedying a special mental disease by stimulating the sense of smell by an essential oil or extract of an aromatic plant or herb medicine has been established as "aromatherapy", and, for example, there can be mentioned the remedy of a psychosomatic disorder by noting and utilizing a spiritual effect by scenting a fragrance. Various trials have been made to obtain a health-promoting effect similar to this aromatherapeutic effect by applying such plant essential oil perfumes to bedding articles, interior articles, inner house materials or indoor articles. However, plant essential oil components utilized for the aromatherapy consist of a great number of compounds. Accordingly, in order to obtain an aromatherapeutic effect in a true sense, it is necessary to use specific natural essential oils and specific components isolated from natural essential oils in combination.

In the present invention, it is recommended to use a perfume comprising the following natural essential oils and components isolated from natural essential oils: (1) 10 to 20% of lemon oil, (2) 5 to 15% of bergamot oil, (3) 2 to 8% of lavender oil, (4) 2 to 8% of lemongrass oil, (5) 2 to 8% of cedarwood oil, and (6) 0.5 to 1.5% of jasmine absolute.

Lemon oil is an essential oil obtained by compressing the rind and fruit of lemon, and contains as main components d-limonene (90%), citral, linalool, and octanol. In the "Pharmacological Effect of Aromatherapy", Fragrance Journal, No. 65 (1984), page 40, it is stated that lemon oil has antipsoric, antispasmodic, and refreshing actions. In the present invention, it is preferred that lemon oil be incorporated in an amount of 10 to 20% by weight in the essential oil mixture. It the amount of lemon oil is smaller than 10% by weight, the lemon oil effect is low, and even if lemon oil is incorporated in an amount exceeding 20% by weight, no substantial increase of the effect can be expected.

Bergamot oil is an essential oil obtained by compressing the unripe rind of bergamot belonging to the orange family, and contains as main components linalyl acetate (38 to 44%), linalool (20 to 30%), methyl anthranilate, and limonene. In the above-mentioned literature reference, it is taught that bergamot oil has an effect of moderating melancholy and depression.

In the present invention, it is preferred that bergamot oil be incorporated in an amount of 5 to 15% by weight into the essential oil mixture. If the amount of bergamot oil is smaller than 5% by weight, the effect of bergamot oil is low, and even if bergamot oil is incorporated in an amount exceeding 15% by weight, no substantial increase of the effect can be expected.

Lavender oil is an essential oil obtained by steam distillation and solvent extraction of a flower of lavender belonging to the beefsteak plant family, and contains linalyl acetate (35 to 55%), linalool (15 to 20%), 3-octanone, and lavandulol as main components. In the above-mentioned literature reference, it is taught that lavender oil has an effect of calming uneasy feelings and relaxing tension. In the present invention, it is preferred that lavender oil be incorporated in an amount of 2 to 8% by weight in the essential oil mixture. If the amount of lavender oil is smaller than 2% by weight, the lavender oil effect is low, and even if lavender oil is incorporated in an amount exceeding 8% by weight, no substantial increase of the effect can be expected.

Lemongrass oil is an essential oil obtained by steam distillation of a lemongrass leaf belonging to the family of true grasses (growing in India and China), and contains as main components citral (75 to 85%), geraniol, and methylheptenone. In the "Effect of Aromatherapy", Fragrance Journal, No. 65 (1984), page 46, it is taught that citral as the main component of lemongrass oil has vasolidating and hypotensive actions. It is preferred that lemongrass oil be incorporated in an amount of 2 to 8% in the essential oil mixture of the present invention. If the amount of lemongrass oil is smaller than 2% by weight, the effect is low, and even if the amount of lemongrass oil exceeds 8% by weight, no substantial increase of the effect can be attained.

Cedarwood oil is an essential oil obtained by steam distillation of the trunk and bark of cedarwood (red cedar) of the cypress family growing in North America, and it contains cedrol (3 to 14%) and cedrene (80%) as main components. Cedarwood oil has a cedar fragrance volatilized and floating in a forest and a tranquilizing effect by the aroma of cedarwood. In the present invention, it is preferred that cedarwood oil be incorporated in an amount of 2 to 8% by weight in the essential oil mixture. If the amount of cedarwood oil is smaller than 2% by weight, the cedarwood oil effect is low, and if the amount of cedarwood oil exceeds 8% by weight, the scent of cedar tree becomes unnaturally strong. The pharmacological action of cedarwood (red cedar) on animals is disclosed in the "Ecology of Forest and Action of Volatile Substance", Fragrance Journal, No. 65 (1984), page 7, and it is taught that cedarwood has an antihypnotic effect.

Jasmine absolute is an essential oil obtained by solvent extraction of a flower of jasmine belonging to the oleaceous family, and it contains as main components benzyl acetate (65%), linalool (15%), benzyl alcohol, geraniol (10%), and cis-jasmone (3%). In the "Pharmacological Effect of Aromatherapy", Fragrance Journal, No. 65 (1964), page 40, it is taught that jasmine absolute has an effect of soothing erethism and hysteris. In the present invention, it is preferred that jasmine absolute be incorporated in an amount of 0.5 to 1.5% by weight in the essential oil mixture. If the amount of jasmine absolute is smaller than 0.5% by weight, the jasmine absolute effect is insufficient, and since jasmine absolute is expensive, incorporation of jasmine absolute in an amount exceeding 1.5% by weight is not preferred from the economical viewpoint.

As another preferred combination of natural essential oils and components isolated from natural essential oils, to be incorporated into the core-constituting polymer in the present invention, there can be mentioned an essential oil mixture comprising (1) 20 to 30% of α-pinene, (2) 15 to 25% of cedarwood oil, (3) 5 to 15% of abies oil, (4) 5 to 15% of pine needle oil, (5) 2 to 8% of orange oil, and (6) 0.5 to 3.5% of eucalyptus oil.

α-Pinene is a component isolated from a natural essential oil and has a boiling point of 155° to 156° C. Turpentine oil collected by steam distillation of crude pine resin contains 60 to 70% by weight of α-pinene, and α-pinene is ordinarily isolated from turpentine oil by reduced pressure distillation. In the "Effect of Aromatherapy ", Fragrance Journal, No. 65 (1984), page 50, it is taught that turpentine oil is effective for expectoration and urination. The contribution of α-pinene, which is the main component of turpentine oil, to this effect is very large. In the present invention, it is preferred that α-pinene be incorporated in an amount of 20 to 30% by weight in the essential oil mixture. If the amount of α-pinene is smaller than 20% by weight, the forest bath effect is insufficient. If the amount of α-pinene exceeds 30% by weight, the ratio of α-pinene becomes different from the ratio of α-pinene floating in a forest.

Cedarwood oil is an essential oil obtained by steam distillation of the trunk and bark of cedarwood (red cedar) of the cypress family growing in North America, and it contains 3 to 14% by weight cedrol and 80% by weight of cedrene. Cedarwood oil contains the main component of a cedar fragrance volatilized and floating in a forest and it has a tranquilizing effect by the aroma of cedarwood. In the present invention, it is preferred that cedarwood oil be incorporated in an amount of 15 to 25% by weight in the essential oil mixture. If the amount of cedarwood oil is smaller than 15% by weight, the fragrance of cedarwood is insufficient, and if the amount of cedarwood oil exceeds 25% by weight, the cedar tree scent becomes unnaturally strong. The pharmacological action of cedarwood (red cedar) on animals is disclosed in "Ecology of Forest and Action of Volatile Substance", Fragrance Journal, No. 65 (1984), page 7, and it is taught that cedarwood has an antihyphotic effect.

Abies oil is an essential oil obtained by steam distillation of a branch or leaf of a plant of the pinaceous family, for example, fir growing in Siberia, and it contains 30 to 40% by weight of bornyl acetate and 10% by weight of camphene. In "Pharmacological Effect of Aromatherapy", Fragrance Journal, No. 65 (1984), page 40, it is taught that camphene has an effect of tranquilizing the unstable mental condition (spleen, shock or the like) and exciting the central nervous system. In the present invention, it is preferred that abies oil be incorporated in an amount of 5 to 15% by weight in the essential oil mixture. If the amount of abies oil is smaller than 5% by weight, the phermacological effect is insufficient, and if the amount of abies oil exceeds 15% by weight, the composition differs from the ratio of camphor floating in a forest.

Pine needle oil is an essential oil obtained by steam distillation of a needle leaf of a plant of the pinaceous family, and it contains pinene, limonene and camphene as main components. In the present invention, it is preferred that pine needle oil be incorporated in an amount of 5 to 15% by weight in the essential oil mixture. If the amount of pine needle oil is smaller than 5% by weight, the pharmacological effects possessed by pinene and camphene are insufficient, and if the amount of pine needle oil exceeds 15% by weight, as in case of abies oil, the composition of limonene and the like is extremely different from that of limonene and the like floating in a forest and the fragrance becomes unnatural.

Small amounts of orange oil and eucalyptus oil are further incorporated in the essential oil mixture in the present invention. Orange oil is an essential oil obtained by compressing the rind of sweet orange or bitter orange, and contains 90% by weight of d-limonene, and n-decyl aldehyde and linalool as main components. With respect to the effect of orange oil, in the "Trends of Research and Development of Phytoncide, Fragrance Journal, No. 65, page 12, it is taught that orange oil (especially sweet orange oil) has a fungicidal action. Eucalyptus oil is an essential oil obtained by steam distillation of a leaf of eucalyptus, and it contains cineole, piperitone, α-phellandrene nd citronellal as main components. In the "Effect of Aromatherapy", Fragrance Journal, No. 65 (1984), page 46, it is taught that eucalyptus oil is effective for expectoration.

In the present invention, it is preferred that orange oil and eucalyptus oil be incorporated in amounts of 2 to 8% by weight and 0.5 to 3.5% by weight, respectively, in the essential oil mixture. If the amount of orange oil or eucalyptus oil is smaller than 2% by weight or 0.5% by weight, the effect is insufficient and the scent balance of the essential oil mixture is lost and the scent becomes unnatural. If the amount of orange oil or eucalyptus oil is larger than 8% by weight or 3.5% by weight, no substantial increase of the effect can be attained.

In addition to the natural essential oils and components isolated from natural essential oils, other natural essential oils and components isolated from natural essential oils may be incorporated into the essential oil used in the present invention. More specifically, at least one natural essential oil selected from amyris oil, cajeput oil, ambrette seed oil, galbanum oil, elemi oil, oak moss oil, ocotea oil, guaiac wood oil, camphor oil, styrex oil, geranium oil, pine oil, patchouli oil, Japanese mint oil, Peru balsam oil, bitter almond oil, hiba oil, pennyroyal oil, bergamot oil, benzoin oil, bois de rose oil, ho oil, mandarin oil, and lemon oil is preferably incorporated in the essential oil mixture used in the present invention.

As means for incorporating (dispersing or dissolving) natural essential oils and components isolated from natural essential oils, there can be adopted any of various methods now adopted on an industrial scale. For example, there can be mentioned a method in which a powdery or granular thermoplastic polymer and a predetermined amount of an essential oil mixture as described above are charged in a V-blender as shown in FIG. 9, the essential oil mixture is uniformly applied to the surface of the polymer by rotation, the resulting mixture is supplied to a composite melt-spinning apparatus as shown in FIG. 10 and the essential oil mixture is incorporated and dispersed into the polymer by utilizing a kneading action of an extruder. In FIG. 10, reference numeral 4 corresponds to an extruder; 5 to a spinning head; 6 to an orifice; 7 to an oiling roller; 8 to a take-up roller; and 9 to a can.

The present invention will now be described in detail with reference to the following examples.

EXAMPLE 1

Figure 9:
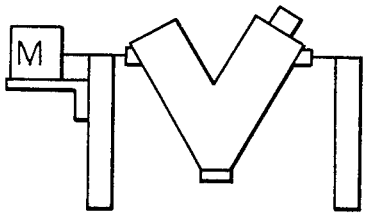
FIG. 9 is a schematic view showing a V-blender.
Figure 10:
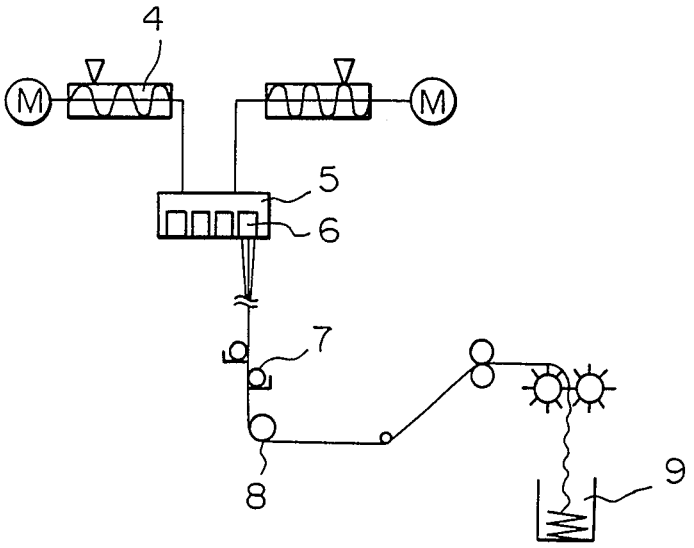
FIG. 10 is a schematic view illustrating an example of the composite melt-spinning apparatus to be used for the production of the hollow sheath-core composite fiber of the present invention; and, FIG. 11 is a schematic view illustrating an example of the drawing apparatus to be used for the production of the hollow sheathcore composite fiber of the present invention.
Figure 11:
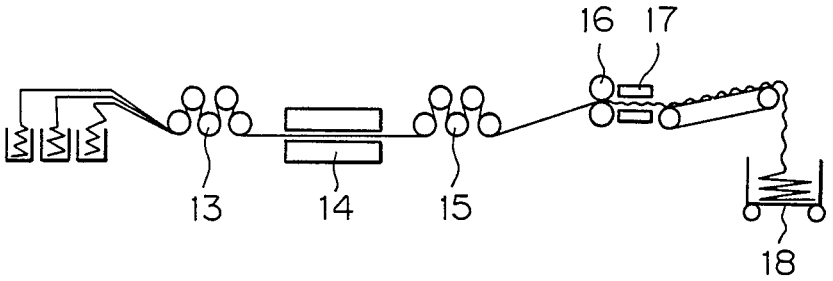

Strawberry PH-6667 (perfume supplied by Takasago Koryo Kogyo K.K. and having a boiling point of 256° C.) was incorporated in an amount of 1% by weight in NUC Polyethylene DNOJ-04C5 (polyethylene supplied by Nippon Unicar K.K. and having a density of 0.914 and a melt index of 25) and the composition was sufficiently mixed by a V-blender as shown in FIG. 9 to uniformly sprinkle polyethylene beads with the perfume. The polyethylene beads and dried polyethylene terephthalate (having an intrinsic viscosity of 0.068) were supplied to a composite melt-spinning apparatus as shown in FIG. 10 so that the polyethylene was arranged in the core and the polyethylene terephthalate was arranged in the sheath, and they were spun at 270° C. in the form of a sheath core composite filament from a composite melt-spinning spinneret apparatus as shown in FIG. 2, to which a spinneret having a spinning extrusion hole as shown in FIG. 4-(A) was attached. The extruded filament was cooled by cooling air and an oiling agent was applied to the fiber, and the filament was taken up at 600 m/min and introduced into a can. The so-obtained undrawn filament had a cross-section as shown in FIG. 6. The undrawn filament was collected to form an undrawn filament sliver having a size of 800,000 denier, and the sliver was supplied to a lateral drawing apparatus as shown in FIG. 11, drawn at a draw ratio of 4.0 at a speed of 50 m/min, heat-treated in a non-contact type dry heating boxy 180° C.), crimped at a crimp number of 10 crimps per inch by a mechanical crimping apparatus, and introduced into a container. In FIG. 11, reference numeral 13 corresponds to drawing rollers; 14 to a dry heating box; 15 to take-up rollers; 16 to a crimper roll pair for imparting mechanical crimps to a sliver; 17 to a crimper box; and 18 to a tow container. The drawn sheath-core composite filament tow was subjected to a wet heat treatment at 130° C. for 10 minutes in an autoclave. The two was cut into staple fibers having a length of 64 mm and a size of 15 denier. The so-obtained sheath-core composits fiber having a hollow portion was mixed in an amount of 10% by weight with Luna Ace L-55 (6 denier, 64 mm cut polyester staple fiber for quilt wadding supplied by Mitsubishi Rayon K.K.) and the mixed fiber was opened by a card. When the obtained sheet-like web was used as a wedding of a mattress, a child's mattress having a scent of strawberry was obtained. Even after the mattress was subjected to dry cleaning, the scent of strawberry did not disappear.

EXAMPLE 2

An essential oil mixture (Aromathera PH-8565 supplied by Takasago Koryo Kogyo K.K.) comprising 15% by weight of lemon oil, 10% by weight of bergamot oil, 5% by weight of lavender oil, 5% by weight of lemongrass oil, 5% by weight of cedarwood oil, 1% by weight of jasmine absolute and 59% by weight of other components was incorporated in an amount of 1% by weight into polyethylene having a melt index of 7.0 (Ultzex 4570 supplied by Mitsui Petrochemical Co., Ltd.), and the composition was sufficiently mixed by a V-blender as shown in FIG. 9 to uniformly sprinkle polyethylene beads with the essential oil mixture.

The polyethylene beads and dried polyethylene terephthalate (having a relative viscosity of 1.63) were supplied into a composite melt-spinning apparatus as shown in FIG. 10 so that the polyethylene was arranged in the core and the polyethylene terephthalate was arranged in the sheath, and they were melt-spun at 270° C. in the form of a sheath-core composite filament from a composite melt-spinning spinneret apparatus as shown in FIG. 2, to which a spinneret having a spinning extrusion hole as shown in FIG. 4-(A) was attached. The extruded filament was cooled by cooling air, an oiling agent was applied to the filament, and the filament was taken up at 600 m/min and introduced into a can.

The so-obtained undrawn filament had a cross-section as shown in FIG. 1-(A). The undrawn filament was collected to form an undrawn filament sliver having a size of 800,000 denier. The sliver was supplied into a lateral drawing apparatus as shown in FIG. 11, drawn at a draw ratio of 4.0 at a speed of 50 m/min, heat-treated in a non-contact type dry heating box (180° C.), crimped at a crimp number of 10 crimps per inch by a mechanical crimping apparatus and introduced into a container.

The drawn sheath-core composite filament two introduced into the container was then heat-treated at 130° C. for 10 minutes in an autoclave and then cut in 64 mm lengths to form staple fibers having a size of 15 denier.

The so-obtained staples of the hollow sheath-core composite fiber of the present invention were mixed in an amount of 30% by weight with polyester staple fibers of 6 denier and 64 mm cut length (Luna Ace L-55 supplied by Mitsubishi Rayon K.K.) and the mixed fiber was opened by a card. When the obtained sheet-like web was used as a wadding for a mattress, a mattress having an aroma-therapeutic scent and showing an effect of giving comfortable sleep was obtained. This aromatherapeutic scent did not disappear after dry cleaning. Even after the lapse of 3 months, the intensity of the fragrance was not changed, and it was found that the fragrance was durable.

EXAMPLE 3

An essential oil mixture (Aromathera PH-8564 supplied by Takasago Koryo Kogyo K.K.) comprising 25% by weight of α-pinene, 20% by weight of cedarwood oil, 10% by weight of abies oil, 10% by weight of pine needle oil, 5% by weight of orange oil, 2% by weight of eucalyptus oil and 28% by weight of other components was incorporated in an amount of 1% by weight in polyethylene having a melt index of 7.0 (Ultzex 4570 supplied by Mitsui Petrochemical Co., Ltd.), and the composition was sufficiently mixed by a V-blender as shown in FIG. 9 to uniformly sprinkle polyethylene beads with the essential oil mixture.

The polyethylene beads and dried polyethylene terephthalate having a relative viscosity of 1.63 were supplied into a composite melt-spinning apparatus as shown in FIG. 10 so that the polyethylene was arranged in the core and the polyethylene terephthalate was arranged in the sheath, and they were melt-spun at 270° C. in the form of a sheath-core composite filament from a composite melt-spinning spinneret apparatus as shown in FIG. 2, to which a spinneret having a spinning extrusion hole shown in FIG. 4-(A) was attached. The extruded filament was cooled by cooling air, an oiling agent was applied to the filament, and the filament was taken up at 600 m/min and introduced in a can.

The so-obtained undrawn filament had a crosssection as shown in FIG. 1-(A). This undrawn filament was collected to form an undrawn filament sliver having a size of 800,000 denier. The sliver was supplied to a lateral drawing apparatus shown in FIG. 11, drawn at a draw ratio of 4.0 at a speed of 50 m/min, heat-treated in a non-contact dry heating box (180° C.), crimped at a crimp number of 10 crimps per inch and introduced into a container.

The drawn sheath-core composite filament tow introduced in the container was heat-treated at 130° C. for 10 minutes in an autoclave and cut into 64 mm to form staple fibers having a size of 15 denier.

The so-obtained staples of the hollow sheath-core composite fiber of the present invention were mixed in an amount of 30% by weight in polyester staple fibers of 6 denier and 64 mm cut length (Luna Ace L-55 supplied by Mitsubishi Rayon K.K.), and the mixed fiber was opened by a card to form a sheet-like web. When this web was used as a wadding for a mattress, there was obtained a mattress having a forest scent. This forest scent was not caused to disappear by dry cleaning. Even after the lapse of 3 months, the intensity of the forest scent was not changed. It was found that the forest scent was durable.

As is apparent from the foregoing description, according to the present invention, there can be provided a fiber having a fragrance or forest bath effect which has an excellent washing resistance, is gradually reduced and lasts for a long time. When the fiber of the present invention is applied to bedding and interior articles such as (1) a wadding for a mattress or coverlet, (2) a wadding for a pillow, (3) a wadding for a cushion or stuffed doll, (4) a pile yarn of a blanket, (5) a loop yarn or cut pile yarn of a carpet, (6) a curtain, and (7) a wadding for a chair, a fragrance or forest bath effect can be enjoyed indoors.

We claim:

1. A fragrant sheath-core composite fiber having a cross-section comprising a sheath and a core including a hollow portion along the entire cross-section thereof, wherein an aromatic perfurme having a boiling point higher than 150° C. under normal pressure is incorporated and dispersed in an amount of 0.1 to 10.0% by weight in a thermoplastic polymer constituting the core, said polymer constituting the core being a polyethylene polymer in which at least 70 mole % of recurring units are ethylene recurring units, and the sheath being constituted by a polyethylene terephthalate polymer in which at least 95 mole % of recurring units are ethylene terephthalate recurring units, said aromatic perfume comprising an admixture of essential oils selected from the group consisting of (a) an admixture of lemon oil, bergamot oil, lavender oil, lemongrass oil, cedarwood oil and jasmine absolute, and (b) an admixture of α-pinene, cedarwood oil, abies oil, pine needle oil, orange oil and eucalyptus oil.

2. A fiber as set forth in claim 1, wherein the area ratio of the hollow portion (hollow ratio) in the cross-section of the fiber is at least 10%.

3. A fiber as set forth in claim 1, wherein the volume ratio of the core-constituting polymer to the sheath-constituting polymer is in the range of from 20/80 to 50/50.

4. A fiber as set forth in claim 1, wherein the melt flow index (M.I.) of the core-constituting polyethylene polymer is 0.5 to 25 and the relative viscosity of the sheath-constituting polyethylene terephthalate polymer is 1.55 to 1.70.

5. A fiber as set forth in claim 1, wherein the aromatic perfume is an essential oil mixture comprising (1) 10 to 20% of lemon oil, (2) 5 to 15% of bergamot oil, (3) 2 to 8% of lavender oil, (4) 2 to 8% of lemongrass oil, (5) 2 to 8% of cedarwood oil and (6) 0.5 to 1.5% of jasmine absolute.

6. A fiber as set forth in claim 1, wherein the aromatic perfume is an essential oil mixture comprising (1) 20 to 30% of α-pinene, (2) 15 to 25% of cedarwood oil, (3) 5 to 15% of abies oil, (4) 5 to 15% of pine needle oil, 2 to 8% of orange oil and (6) 0.5 to 3.5% of eucalyptus oil.

7. A fiber as set forth in claim 1, wherein the incorporation and dispersal is effected by a kneading action.

* * * * *